US010183510B2

(12) United States Patent
Blom et al.

(10) Patent No.: US 10,183,510 B2
(45) Date of Patent: Jan. 22, 2019

(54) GUIDE DEVICE FOR GUIDING A PRINTED MEDIUM ONTO A TAKE-UP ROLL IN A PRINTING SYSTEM

(71) Applicant: Océ-Technologies B.V., Venlo (NL)

(72) Inventors: Ronnie E. A. Blom, Venlo (NL); Tom J. H. Clabbers, Venlo (NL); Anne A. Wind, Venlo (NL); Peter F. M. Nacken, Venlo (NL); Maurice J. C. Lemmens, Venlo (NL); Lodewijk T. Holtman, Venlo (NL); Hermanus J. P. M. Philipse, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 206 days.

(21) Appl. No.: 15/291,251

(22) Filed: Oct. 12, 2016

(65) Prior Publication Data

US 2017/0106681 A1 Apr. 20, 2017

(30) Foreign Application Priority Data

Oct. 14, 2015 (EP) ..... 15189787
Mar. 15, 2016 (EP) ..... 16160392

(51) Int. Cl.
*B41J 15/04* (2006.01)
*B41J 2/01* (2006.01)
(Continued)

(52) U.S. Cl.
CPC ..... *B41J 15/046* (2013.01); *B65H 19/24* (2013.01); *B65H 20/32* (2013.01);
(Continued)

(58) Field of Classification Search
CPC .... B41J 15/046; B65H 20/32; B65H 23/0322; B65H 23/10; B65H 23/24; B65H 29/008;
(Continued)

(56) References Cited

U.S. PATENT DOCUMENTS

2013/0100223 A1 4/2013 Sato et al.
2015/0029282 A1 1/2015 Hirabayashi
2016/0304306 A1* 10/2016 Ishibashi ..... B65H 35/04

FOREIGN PATENT DOCUMENTS

JP 60-19635 A 1/1985
JP 2004-51264 A 2/2004

* cited by examiner

*Primary Examiner* — Thinh H Nguyen

(74) *Attorney, Agent, or Firm* — Birch, Stewart, Kolasch & Birch, LLP

(57) ABSTRACT

The present invention provides a guide device for guiding print medium onto a take-up roll in a printing system. The guide device comprises a first guide member presenting a substantially planar surface for limiting or preventing lateral deviation of a printed medium output from the printing system as the medium moves along a transport path towards a take-up roll for winding or taking up a length of the medium. The first guide member is stationary in use. A position of the first guide member is adjustable in a direction transverse to the transport path for setting the position to limit or prevent lateral deviation of the medium along the transport path. The guide device further comprises a second guide member presenting a support surface configured and arranged to support the medium thereon as the medium travels along the transport path towards the take-up roll. The first guide member and the second guide member are preferably integrally formed as a guide unit. Further, the invention provides a printing system which incorporates such a guide device.

20 Claims, 4 Drawing Sheets

(51) Int. Cl.

| | |
|---|---|
| ***B65H 29/52*** | (2006.01) |
| ***B65H 23/04*** | (2006.01) |
| ***B65H 19/24*** | (2006.01) |
| ***B65H 20/32*** | (2006.01) |
| ***B65H 23/032*** | (2006.01) |
| ***B65H 23/10*** | (2006.01) |
| ***B65H 29/00*** | (2006.01) |

(52) U.S. Cl.
CPC ..... *B65H 23/0322* (2013.01); *B65H 23/10* (2013.01); *B65H 29/008* (2013.01); *B65H 29/52* (2013.01); *B65H 2301/41441* (2013.01); *B65H 2301/41447* (2013.01); *B65H 2301/44921* (2013.01); *B65H 2301/5151* (2013.01); *B65H 2404/74* (2013.01); *B65H 2511/12* (2013.01); *B65H 2511/20* (2013.01); *B65H 2511/242* (2013.01); *B65H 2553/41* (2013.01); *B65H 2701/1311* (2013.01); *B65H 2701/1313* (2013.01); *B65H 2701/1315* (2013.01); *B65H 2801/12* (2013.01); *B65H 2801/36* (2013.01)

(58) Field of Classification Search
CPC ..... B65H 19/24; B65H 29/52; B65H 2301/41441; B65H 2301/41447; B65H 2301/44921; B65H 2404/74; B65H 2801/36; B65H 2801/12
See application file for complete search history.

GUIDE DEVICE FOR GUIDING A PRINTED MEDIUM ONTO A TAKE-UP ROLL IN A PRINTING SYSTEM

FIELD OF THE INVENTION

The present invention relates to a guide device for guiding print medium, such as medium, onto a take-up roll in a printing system, especially in a roll-to-roll printing system. The present invention also relates to a printing system that includes a guide device for guiding print medium in order to improve and/or optimize the productivity and work-flow of the system.

BACKGROUND OF THE INVENTION

In printing systems, and especially roll-to-roll printing systems, in which the printed media output from the printing system is in the form of generally continuous medium, the printed medium is collected or gathered by winding the medium onto a take-up roll. In doing so, there is always the issue of ensuring the printed medium or medium is wound onto the roll in an orderly and consistent manner, i.e. without any skewing and without creases or damaged edges. If the printed medium or medium suffers from skewing and/or creases or damaged edges, not only can this seriously impair or damage the quality of the printed output, but a print medium jam could arise and/or an operator may have to correct the problem manually. The time required for a manual intervention by an operator to investigate and correct such a problem can be significant. In some cases, the printing system must be temporarily stopped or interrupted, and the printed medium may be damaged to such an extent that a re-run of the print-job is also necessary, all of which can have a major impact upon system productivity.

One of the techniques used to date in an effort to ensure an orderly winding of the printed medium onto a take-up roll has been to provide flanges on the ends of the take-up roll, and especially on the ends of the take-up roll core, onto which the printed medium is wound. In this regard, a take-up roll typically includes a roll "core" formed as tubular or cylindrical roll comprised of cardboard or plastic or any other suitable material onto which the printed medium is wound. In some cases, however, this technique of providing flanges on the ends of the roll core has a tendency to cause damage to the edges of the printed medium as it is wound onto the driven and rotating take-up roll. It also has a disadvantage that the take-up roll core must be specifically selected to have the same size as the width of the printed medium. A further problem arises when feeding the web medium from the take-out roll in the loading tray through the printing system to the take-up roll. The transport path needs to be free of obstructions to avoid damaging the medium. When the flanges are not aligned with respect to the side edges of the medium moving towards the flanges, the medium may come into contact with the one or both of the flanges. The medium may thereby be damaged or directed outside of the transport path. When using automatic web feeding by means of a transport mechanism, collision between the flanges and the medium will likely result in a paper jam, and in consequence downtime of the printing system and a loss of print material. When using manual feeding an operator is required to first bring the medium to flanges, then release the web medium and reposition the flanges, after which the web medium is brought to the take-up roll. This operation is not only cumbersome and time consuming, but may cause contamination of the medium as the operator cannot simultaneously hold the sheet and reposition the flanges. It would therefore desirable to provide a new and improved means for guiding a print medium onto a take-up roll in a printing system.

SUMMARY OF THE INVENTION

In view of the above, an object of the invention is to provide a new and improved guide device for guiding a printed medium onto a take-up roll in a printing system for increased productivity, as well as a printing system which includes such a guide device.

In accordance with the present invention, a guide device for guiding print medium, such as continuous medium, onto a take-up roll in a printing system as recited in claim 1 is provided. Advantageous and/or preferred features of the invention are recited in the dependent claims.

According to one aspect, therefore, the present invention provides a guide device for guiding printed medium onto a take-up roll in a printing system, comprising a first guide member presenting a substantially planar surface for limiting or preventing lateral deviation of printed medium output from the printing system as the medium travels along a transport path towards a take-up roll for winding or taking up a length of the printed medium. A first actuator is provided for adjusting or setting a position of the first guide member in a direction transverse to the transport path, and typically generally parallel to a plane of the medium, for setting the position to limit or prevent lateral deviation of a printed medium along a transport path. The guide device further comprises a controller assembly, which comprises a sensor and a controller. The sensor is arranged for determining a lateral position of a medium on the transport path and generating lateral position data. The controller is configured for receiving the lateral position data and controlling the first actuator to set the position of the guide member in correspondence with the lateral position of the medium to prevent lateral deviation of the medium along the transport path.

In this way, unlike the known rotating flanges, which are always mounted on the core of the take-up roll or receiving roll and therefore only work with print medium or medium having the same width as the core, the guide device of the invention does away with the need for such rotating flanges. Instead, the inventive guide device is deployed independently of the core (upstream of the take-up roll on the transport path) and is adjustable to accommodate web media or sheets having different sizes or widths. This, in turn, makes it possible to use a print medium that is narrower in width than a particular take-up roll core length. The controller of the guide device of the present invention is then simply able to adjust the first guide member to a suitable position or width based on the determined lateral position of the medium. The controller thus sets the first guide member to suit the print medium (i.e. a web) that is currently in use in the printing system. Overall, this provides for a less cumbersome and more flexible printing system, wherein productivity is increased as the first guide member is correctly positioned before the medium arrives at the first guide member.

Thus, in a typical embodiment of the guide device of the invention, the first guide member (and, indeed, the entire guide device) is fixed or stationary in use and the controller is arranged for adjusting the position of the first guide member along an axis in a direction transverse to the transport path and roughly parallel to a plane of the medium. In this way, the during use stationary first guide member can be positioned on the transport path upstream and independently of the take-up roll core to limit or prevent lateral deviation of a printed medium along the transport path. Additionally, the controller is configured to position the first guide member in a suitable position based on the sensed lateral position data before the medium can come into contact with the first guide member. Collisions between the medium and the first guide member are prevented, eliminating downtime due to such collisions and increasing productivity. Thereby, the object of the present invention has been achieved.

In an embodiment, the sensor is positioned along the transport path upstream of the first guide member, which guide member is positioned upstream of the take-up roll. The sensor is thus arranged to sense or determine the lateral position of a section of the medium before said section of the medium arrives at the first guide member. The controller is then able to set a suitable position of the first guide member such that the first guide member is positioned or aligned with respect to a side edge of the section of the medium. When feeding a leading edge section of the medium to the take-up roll, the controller is thus arranged to set the first guide member in a suitable position to prevent contact between the leading edge of the medium and the guide members. The medium may thus be fed unimpeded to the take-up roll.

In a further embodiment, the controller is further arranged for adjusting the position of the first guide member between a media feeding position wherein the first guide member is positioned, such that transport of the medium on the transport path is unimpeded by the first guide member, and an operative position wherein the first guide member is positioned laterally inside the transport path for contacting a side edge of the medium to prevent lateral deviation of the medium along the transport path. The controller is thus arranged to position the first guide member outside the path or trajectory of the medium being fed before arrival of the medium at the guide member. Preferably, the media feeding position positions the first guide member outside the media transport path, such that regardless of the width medium collisions between the leading edge and the first guide member are avoided. In the operative position the first guide member is positioned with respect to a side edge of the medium. The guide member and the side edge may be substantially aligned in the direction of the transport path, such that any later deviation of the medium results in a lateral force on the medium due to contact between the first guide member and the medium. The lateral force prevents further deviation of the medium, and/or returns the medium to its desired lateral position.

In a preferred embodiment, the first guide member is configured—for example, via attachment means—to be mounted on a shaft or rod for adjustment of its position along the axis transverse to the transport path. In this regard, the axis is preferably a longitudinal axis of the shaft or rod and the first guide member may be slidable along the shaft or rod in the axial direction; e.g. via the attachment means. The attachment means is naturally configured or may be controlled by the controller to fix or lock the position of the first guide member once an appropriate or desired position has been selected or reached. Preferably, the first guide member with the substantially planar surface comprises a flange member. In a further embodiment, the contact surface is provided on the flange member, for example at an angle with a plane of the transport path for laterally urging the medium back to its desired position. In this context, the attachment means may include an opening or aperture in the first guide member or flange member for receiving the shaft or rod upon which the first guide member is mounted. The opening or aperture may be configured to interact or interengage with the shaft or rod to exclude a rotation of the first guide member about the longitudinal axis of the shaft or rod.

In a particularly preferred embodiment, the guide device comprises a pair of first guide members. The first actuator is arranged for adjusting or setting a position of each of the first guide members along an axis in a direction transverse to the transport path, and typically generally parallel to a plane of the medium, to limit or to prevent lateral deviation of the medium between the respective contact surfaces of pair of first guide members as the medium travels along the transport path towards the take-up roll.

In another embodiment, the controller is further arranged for adjusting or setting the position of the first guide members between:

- a media feeding position wherein the pair of first guide members is positioned, such that transport of the medium on the transport path is unimpeded; and
- an operative position wherein the pair of first guide members is positioned laterally inside the transport path with a lateral spacing of similar to a width of the medium for contacting the side edges of the medium to prevent lateral deviation of the medium along the transport path. Preferably, the controller is arranged for positioning the pair of first guide members outside the transport path in the media feeding position. It will be appreciated that the lateral width of the transport path may correspond to or be similar to the width of the medium currently being transported to the take-up roll.

In a preferred embodiment of the invention, the guide device further comprises a second guide member presenting a support surface for supporting the printed medium thereon and directing or guiding the medium along the transport path towards the take-up roll. To this end, the support surface of the second guide member may be comprised of a low friction material or have a low friction coating to promote easy passage of the medium along the transport path. In a particularly preferred form, the support surface of the second guide member is curved and is arranged to direct or guide the printed medium from a buffer zone of the printing system towards the take-up roll. In this regard, the printing system will typically include a buffer zone to accommodate printed medium, web or sheet when a take-up roll is being changed over. That is, when a take-up roll is full (i.e. when it reaches its maximum medium-carrying capacity), it becomes necessary to replace the full roll at an output end of the printing system. During the change-over, the printing system may continue the printing operation by redirecting printed medium or sheet output from the system to the buffer zone until the new take-up roll is ready to receive the printed medium. The printed medium or sheet which collects or accumulates temporarily in one or more loose folds in the buffer zone is known as a "blouse". Once the new take-up roll core is ready to wind up the folds of printed medium or sheet ("blouse") from the buffer zone, the curved surface of the second guide member is configured and arranged to direct or guide the medium from the buffer zone through a curve defined by the curved surface towards the take-up roll.

In a preferred embodiment of the invention, the first guide member and the second guide member are integrally formed as a guide unit in the guide device. The guide device preferably includes a pair of guide units, with the position of each guide unit being adjustable along the axis in the direction transverse to the transport path. Preferably, the guide units are laterally positionable by means of at least the first actuator. Thereby, both guide units may be positioned out of the way of an incoming medium to avoid collisions during the initial feeding of said medium, whereafter the controller may position the guide units in a suitable position to prevent lateral deviation of the medium.

In a particularly preferred form, the support surface of the second guide member is curved concavely downwards and is arranged to direct or guide the printed medium from a buffer zone positioned below the second guide member towards the take-up roll, which take-up roll is preferably positioned below the second guide member. As seen along the transport direction, the transport path may extend upwards from the buffer zone to and over the second guide member. From the second guide member, the transport path preferably extends downwards to the take-up roll. As such, an S-shaped transport path may be formed, which effectively prevent forces from originating from the take-up roll form affecting the part of the medium positioned under the image forming device or print head.

Thus, the guide device in the printing system is configured to provide accurate winding of printed medium without any significant tension in the medium (i.e. relatively slack printed medium at the output of the printing system and/or in the blouse) which nevertheless produces quite a tightly would and compact take-up roll when wound with the medium. The guide device also provides for efficient and easy leading edge attachment to a new receiving roll or take-up roll core, as no flanges are required on the core and the core may be wider than the printed medium or sheet. Because there is no need for flanges on the ends of the take-up roll core, this also assists uninterrupted printing and unattended winding, especially after a cut in a roll-to-roll printing system. The operator is no longer required to transfer the flanges to a new take-up roll, such that exchanging a full take-up roll for an empty one becomes a relatively fast and simple operation. Preferably, an automated take-up roll changer is used to allow for unattended printing and high productivity.

In a further embodiment, the sensor is positioned upstream of the first guide device for determining a first lateral position of the medium. The controller is further arranged to determine a second lateral position of the medium from the position of the first guide member, and a skewing of the medium with respect to the transport path by comparing the first lateral position and the second lateral position. The first lateral position is determined by the sensor, whereas the second lateral position may be determined from a second sensor. Preferably the second lateral position is derived or determined from the position of the first guide member or members. If skewing is detected corrective action may be taken, such as the controller informing an operator or controlling the first actuator to adjust the position of the first guide member to position the medium in a substantially skew-free position.

In another embodiment, the first guide member comprises a lateral position sensor for sensing a lateral position of the first guide member. The lateral position of the first guide member corresponds to a lateral position of the medium. Thus, the lateral position of the medium may be derived from the lateral position of the first guide member. In an embodiment, the first guide member is laterally moveable under the influence of a lateral force from the medium. During skewing the medium may then push the first guide member laterally. As such, the lateral position of the first guide member may be compared to the first lateral position to determine or detect skewing of the medium.

In an even further embodiment, the controller is further arranged for comparing the determined skewing to a skewing reference, and emitting an alert signal when the skewing exceeds the skewing reference. The skewing reference may include a skewing angle threshold, which determines a maximum allowed skew angle of the medium with respect to the direction of the transport path. When the determined skewing is greater than said threshold, the controller generates an alert signal to the operator. The operator is then informed and may take appropriate action to correct the skewing. The controller may also be arranged to take said action, for example by actuating the first guide member or members to laterally move the medium to a desired position to reduce or minimize skewing. The controller then preferably aligns the medium at the first guide member with the first lateral position of the medium as sensed by the sensor.

In another embodiment, the sensor is a side edge sensor for determining a lateral position of at least one side edge of the medium on the transport path. The sensor may be an optical sensor such as a CCD camera. The sensor may be translatable laterally, for example by attachment to the print carriage, or provided as a page-wide array. A side edge contact sensor may also be applied.

According to a further aspect, the present invention provides a printing system comprising a guide device for guiding print medium onto a take-up roll according to any one of the embodiments described above.

In a preferred embodiment, the printing system according to the present invention, further comprises a further guide device positioned upstream of the guide device, such that a buffer zone is formed between the guide device and the further guide device. The buffer zone is arranged for forming an S-shaped region of the medium. Thereto, the buffer zone may comprise an S-shaped transport path. The buffer zone may accommodate printed medium or medium when a take-up roll is being changed over.

The buffer zone or "blouse" effectively decouples the medium from forces acting on it by introducing additional degrees of freedom in the medium: the S-shaped medium has more degrees of freedom than a straight medium. Pulling or tension forces may originate from the take-up roller, but are minimized on the medium under the print head, since the blouse removes the tension in the medium. Thus, pulling on the medium by the take-up roller does not affect print quality. This also allows for easy alignment of the medium on the take-up roll. The e.g. S-shaped curve of the medium in the "blouse" allows movement of the leading edge with respect to the part of the medium upstream of the blouse. This is due to additional degrees of freedom which are introduced in the medium in the buffer zone by means of the S-shaped transport path. This freedom allows the operator to attach the leading edge to the take-up roll core with little force.

Damage to the medium on the guide device is prevented, since the blouse removes lateral forces and tension in the medium. If there were tension, the curved second guide member might cut into the edge of the medium. Also, as the medium passes over the curved second guide member, it becomes locally stiffer and the likelihood of buckling is reduced. The additional curves of the S-shaped blouse enhance local stiffness of the medium compared to e.g. a C-shaped blouse.

In a further embodiment, the guide device and the further guide device are arranged for moveably supporting the medium in the buffer zone, such that a region of medium between the guide device and the further guide device comprises an upwardly oriented fold, for example a U-shaped fold. The upwardly oriented fold comprises regions of the medium on either side of a central part of the fold which regions extend upwardly from the central part of the medium. The medium generally exits the image forming device or print head device in a substantially horizontal orientation. From the print head, the medium moves along the transport path in the substantially horizontal direction to the further guide device. The transport path, and as such the corresponding region of the medium, between the guide device and the further guide device is substantially U-shaped. The medium may be suspended by the guide device and the further guide device. The transport path extends downwards from the further guide device to a folding or upwardly curved zone, which forms the lowest region of the zone buffer zone. From the folding zone the transport path may extend upwards to the guide device. Both the guide device and the further guide device are positioned above or higher than the folding zone. Thereby, the medium in the buffer zone assumes a U-shape, which extends substantially downward from the further guide device to a fold in the medium in the folding zone and from there upwards to the guide device. The U-shape of the medium prevents forces from the take-up roller from affecting the medium under the print head. As such, forces along a transport direction of the medium may be eliminated in the buffer zone.

In an embodiment, the guide device comprises a second guide member presenting a support surface configured and arranged to support the printed medium there-upon, such that a region of the medium over the support surface comprises a downwardly oriented fold, for example an inverted U-shaped fold. The guide device and the further guide device thereby determine an S-shape of the respective region of the medium, which S-shape introduces additional degrees of freedom in the medium to prevent forces from being transmitted via the region of the medium in the buffer zone. Said fold may curve or bend strongly or weakly over the second guide member. A fold may include any angle of radius or curvature of the medium, wherein the medium is not straight. Basically, the second guide member determines an upwardly inclined region connected to a downwardly inclined region of the medium.

In a further preferred embodiment, the printing system further comprises a take-up roll positioned downstream of, and preferably below, the guide device. The transport path extends downwards from the further guide device into the buffer zone and from the folding zone in the buffer zone upwards to and over the support surface of the guide device to the take-up roll. As such, an S-shaped region or "blouse" of the medium is formed, which effectively decouples one end of the "blouse" from the other by introducing additional degrees of freedom. This effectively prevents forces acting on one end of the "blouse" to disturb the position of the other end of the "blouse".

In another aspect, the present invention provides a printing system comprising a guide device according to the present invention. The printing system preferably comprises a buffer zone for forming a blouse in the medium, wherein the buffer zone is positioned between the sensor and the first guide member. Thereby, the lateral position of a section the medium is determined before said section passes through the blouse to the first guide, which may then adjusted accordingly in a timely manner.

In a preferred embodiment, the printing system further comprises a sensor for determining a position of at least one side edge of the medium, and the guide device further comprises an actuator for positioning the first and/or second guide member in the direction transverse to the transport path in correspondence to the determined position of the at least one side edge of the medium. Thereby, the printing system may, at the start of a print job, automatically set or adjust one or both guide units, such that these are aligned with the side edges of the medium. No operator interference is then required to position a guide unit in line with an incoming side edge in the direction of the transport path.

Preferably, the transport path further extends downward from the guide device to the take-up roll. Downward in this respect may comprise a vertical or sloping direction, i.e. at an angle with the vertical.

Thus, the invention provides a guide device, and a printing system incorporating same, which are configured to provide accurate winding of printed medium without any significant tension in the medium (i.e. relatively slack printed medium at the output of the printing system and/or in the blouse) which nevertheless produces quite a tightly wound and compact take-up roll when wound with the medium. The invention also provides for efficient and easy leading edge attachment to a new receiving roll or take-up roll core, as no flanges are required on the core and the core may be wider than the printed medium of medium. Because there is no longer any need for flanges on the ends of the take-up roll core, this also assists uninterrupted printing and unattended winding, especially after a cut in a roll-to-roll printing system.

In a further aspect, the present invention provides a method for guiding print a medium onto a take-up roll in a printing system, the method comprising the steps:

sensing a lateral position of the medium on a transport path of the printing system for generating lateral position data;

a controller receiving the lateral position data and determining from the lateral position data a position of a first guide member, the first guide member comprising a contact surface for contacting a side edge of a printed medium output from the printing system as the medium moves along the transport path towards a take-up roll for winding up a length of the medium; and setting the first guide member to the determined position to prevent lateral deviation of the medium along the transport path. As an operator needs no longer be concerned with the position of the first guide member or members, web feeding may be performed more quickly and easily, increasing productivity. The method even allows for unattended web feeding. In a preferred embodiment, the step of sensing comprises determining a lateral position of a side edge of the medium.

In another aspect, the present invention provides a method for detecting skew of a web medium, the method comprising the steps:

a sensor sensing a first lateral position of the medium on the transport path;

transporting the medium from the sensor along a contact surface of a first guide member positioned along the transport path to prevent lateral deviation of the medium, the first guide member comprising a contact surface for contacting a side edge of a printed medium output from the printing system as the medium moves along the transport path towards a take-up roll for winding up a length of the medium;

determining a second lateral position of the medium from a position of a first guide member; and comparing the first lateral position and the second lateral position to determine skewing of the medium. The first and second lateral positions are determined at different positions along the transport path, i.e. said positions being spaced apart in the transport direction of the medium. By comparing, the lateral positions of the web medium, skewing may be determined in an accurate and straightforward manner. Preferably, a sensor is provided upstream for determining the first lateral position, while the second lateral position is derived from a sensed or detected position of the first guide member. Thereby, skewing may be continually detected during printing. In a preferred embodiment, the method further comprises the steps of comparing the determined skewing of the medium to a skewing reference, and emitting an alert signal when the determined skewing exceeds the skewing reference. As such, an operator may be informed when the detected skewing exceeds a predefined threshold.

In an embodiment, the method according to the present invention further comprises the step of transporting the medium from the first guide member to a take-up roll. The first guide member is positioned spaced apart and upstream along the transport path from the take-up roller.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

Figure 1:
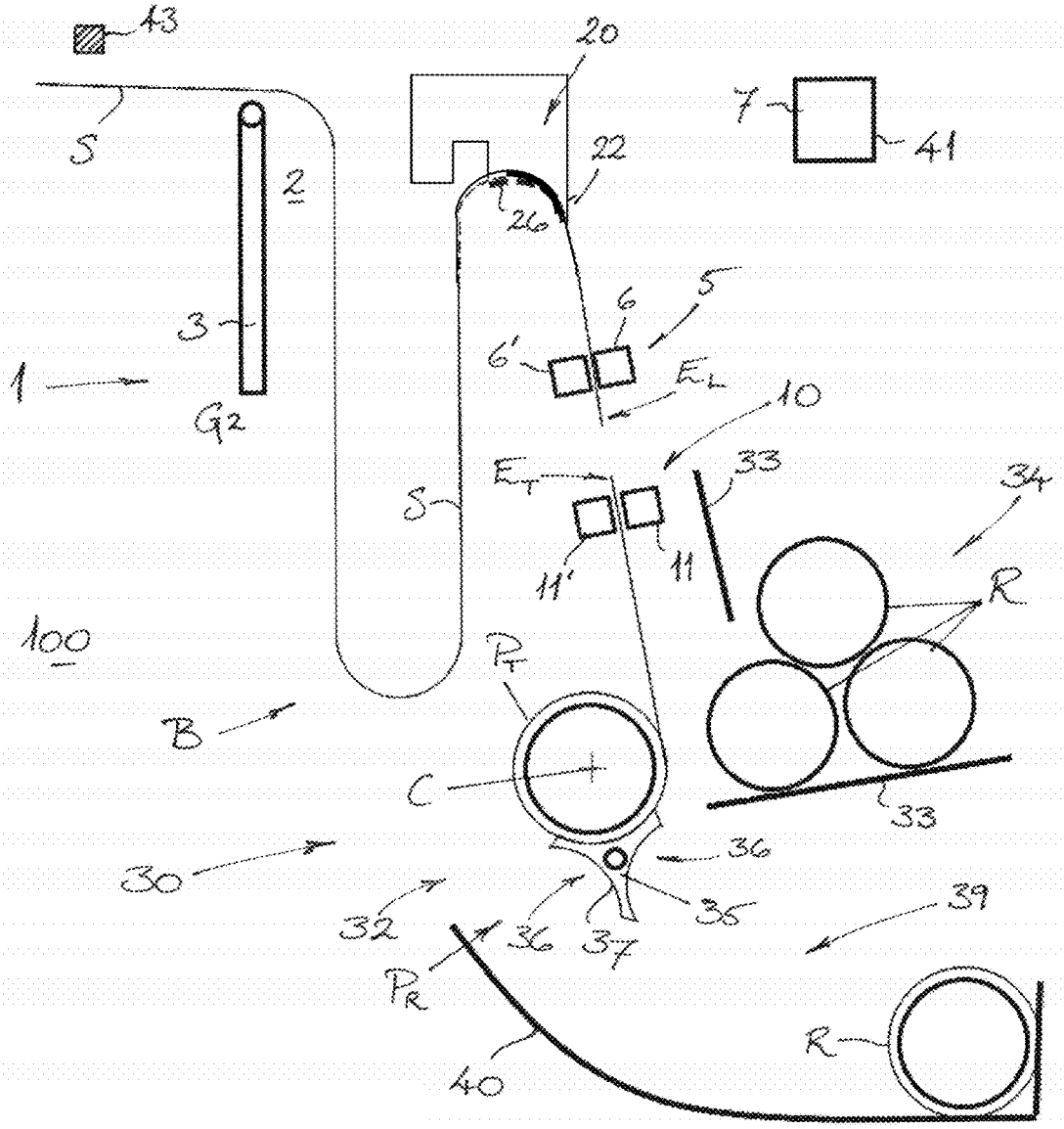
FIG. 1 is a schematic side view of an output end region of a printing system according to an embodiment of the invention including an apparatus for assisting change-over of take-up rolls, a guide device for guiding printed medium or medium to a take-up roll, and an apparatus for handling the take-up rolls.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

The present invention will now be described with reference to the accompanying drawings, wherein the same reference numerals have been used to identify the same or similar elements throughout the several views.

With reference now to FIG. 1 of the drawings, a printing system 100 according to a preferred embodiment and comprising an apparatus 1 for assisting change-over of take-up rolls R for taking up printed medium M is illustrated. The apparatus 1 includes a further guide device 2 comprising a panel-like guide member 3 for directing or guiding a medium M of printed media which is output from the printing system 100 along a transport path P towards a take-up roll R for winding or taking up a length of the printed medium M. The take-up roll R typically comprises a tubular or cylindrical roll "core" formed of cardboard or plastic or any other suitable material, which is mounted in a take-up position $P_T$ in the printing system 100 and is driven in rotation about its central longitudinal axis C for winding or taking up the printed medium M on the roll R. Thus, the printed medium M which is output from the printing system 100 via the apparatus 1 moves along the transport path P by virtue of both "pushing" forces imparted to the medium M by feed rollers (not shown) as well as "pulling" forces imparted to the medium M, for example, by the driven take-up roll R.

The apparatus 1 may further include a cutting device (not shown), such as a knife or a blade, for cutting the printed medium M transversely across a width thereof to terminate or to define a length of the medium M to be wound or taken up onto the take-up roll R. In particular, when the take-up roll R is detected to have reached its capacity or when the print job is detected as having finished, the cutting device is controlled and operated to cut the medium M to end the length of that printed medium M to be wound onto the current take-up roll R. The step of cutting the continuous medium M in this way therefore forms a trailing edge region $E_T$ and a new leading edge region $E_L$ of the printed medium M. Under the influence of both the "pushing" forces and "pulling" forces imparted to the medium M, both the trailing edge region $E_T$ and new leading edge region $E_L$ of the printed medium M continue to travel along the transport path P downstream of the cutter device towards the take-up roll R.

Referring still to drawing FIG. 1, the apparatus 1 includes a first clamping device 5 having a pair of opposed first clamping members or first jaw members 6, 6' which are movable relative to one another between an open position (shown) to allow the medium M to travel along the transport path P towards the take-up roll R, and a closed position to clamp and hold the new leading edge region $E_L$ of the medium M. In particular, the first clamping device 5 is configured to hold the new leading edge region $E_L$ of the printed medium M against movement along the transport path P towards the take-up roll R. The further guide device 2 is configured to cooperate closely with the first clamping device 5 in this regard. Specifically, the panel-like guide member 3 which extends beneath the printed medium M and directs the medium M along the transport path P to the take-up roll is mounted for pivoting movement about a hinge axis between a first position (not shown) and a second position $G_2$. In this way, when the jaw members 6, 6' of the first clamping device 5 close to hold the new leading edge region $E_L$ of the medium M, the guide panel 3 can be moved or pivoted to redirect the printed medium M output from the system 100 to a buffer zone B, where the medium M then collects or accumulates temporarily in one or more loose folds (known as a "blouse").

On the left side of FIG. 1, the printed medium M extends horizontally to and over the further guide device 2. From there the medium M bends or curves downwards into the buffer zone B. In the buffer zone B, the medium M is folded at least once. After this fold, the medium is directed upwards to the guide device 20. Thus, a U-shaped region of the medium M is formed in the buffer zone B. The medium M further curves or folds over the guide device 20. After the guide device 20, the medium M is transported downwards to the take-up roll R. The guide devices 2, 20 are arranged for suspending the medium M in an S-shaped form. This S-shaped "blouse" decouples one end of the medium in the "blouse" from its other end. No forces are transmitted across the buffer zone B ensuring an undisturbed printing process and thereby a high quality print. Also, the medium M after the buffer zone B may be wound onto the take-up roll R free of tension. This reduces the chance of damaging the medium M by contact with the flanges 22, 22'.

The further guide device 2 and the first clamping device 5 are operated by a control unit or controller 7 which typically includes a processor and one or more sensors (not shown). After the knife or blade of the cutting device cuts the medium M, both the trailing edge region $E_T$ and new leading edge region $E_L$ at the cut continue to move along the transport path P towards the take-up roll R. A sensor, such as an optical sensor, positioned on or adjacent to the first clamping device 5 may be configured to detect the new leading edge region $E_L$ of the medium M. Upon detection of the cut or the leading edge region $E_L$ within, or just downstream of, the jaw members 6, 6', the controller 7 may activate the first clamping device 5 to close and thereby clamp and hold the leading edge region $E_L$ and then also to move the panel member 3 of the further guide device 2 to the second position $G_2$ to redirect the medium M emerging from printing heads or from a drying and fixing portion of the printing system 100 to the buffer zone B. At the same time, the take-up roll R is still driven in rotation about the axis C to wind up the final portion of the printed medium M having the trailing edge region $E_T$ formed by the cut. An attachment device (not shown) is provided adjacent the take-up roll R to fix or secure the trailing edge region $E_T$ of the medium M to the roll. In this way, the finished or fully-wound take-up roll R is then ready to be removed or discharged from the take-up position $P_T$ and replaced by a new take-up roll R. This may be performed manually by an operator intervention and/or automatically. After the new take-up roll R is mounted in the take-up position $P_T$, the new leading edge region $E_L$ of the medium M can be released from the first clamping device 5 and the medium M fed or drawn out from the buffer zone to be wound onto the new take-up roll R. Once the buffered portion of the medium is taken up on the roll R, the guide panel 3 is operated to be pivoted back into the first position $G_1$ to guide the printed medium M along the transport path P towards the take-up roll R as before.

The embodiment in FIG. 1 further includes a second clamping device 10 having a pair of opposed second clamping members or second jaw members 11, 11' which are movable relative to one another between an open position (shown) to allow the medium M to travel further along the transport path P onto the take-up roll R, and a closed position for holding the trailing edge region $E_T$ of the medium M. In particular, the second clamping device 10 is configured to hold the trailing edge region $E_T$ of the printed medium M against movement while the take-up roll R continues to be driven in rotation to apply tension to the medium and draw the roll R taught as the winding or taking up of the printed medium M is completed immediately prior to the attachment device (not shown) or operator securing the free trailing edge region $E_T$ to the roll R. In this way, as the first clamping device 5 grips and holds the new leading edge $E_L$ of the medium M and the further guide device 2 is controlled to redirect the emerging printed medium to the buffer zone B, the second clamping device 10 is activated by the controller 7 when a not shown sensor (such as optical sensor) provided on or adjacent to the second clamping device 10 detects the trailing edge region $E_T$ of the medium M approaching the take-up roll R, e.g. within or adjacent to the second jaw members 11, 11'. The second clamping device 10 may thus cooperate with the attachment device to ensure that the take-up roll R is wound and completed as a taught and compact and secure package of printed medium M from the printing system 100 ready to be removed or discharged from the take-up position $P_T$ and replaced with a new take-up roll R.

Figure 3:
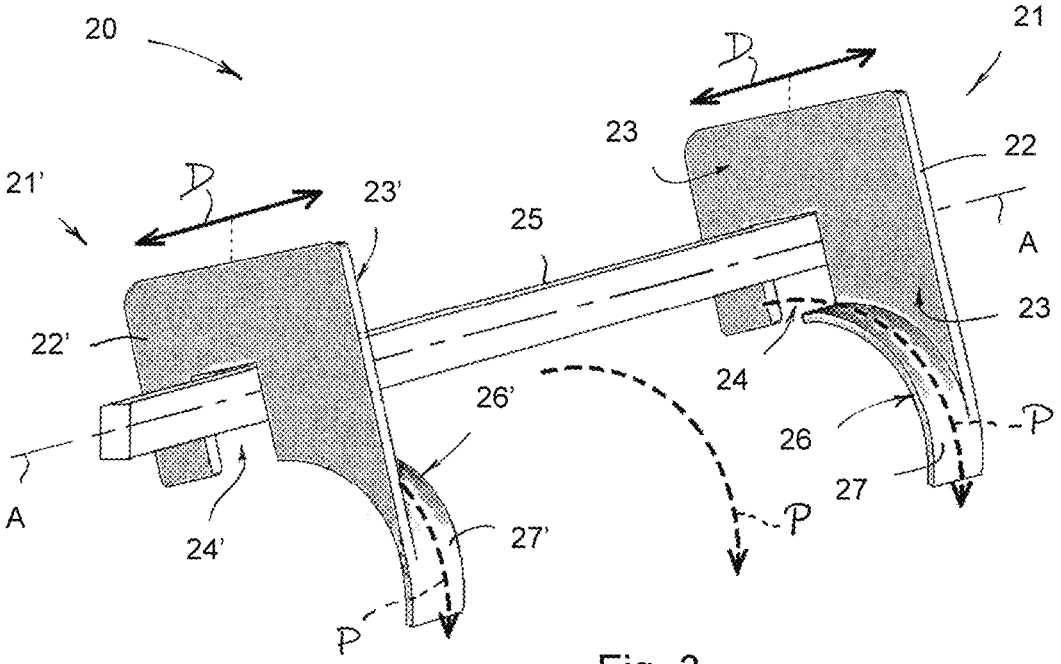
FIG. 3 is a schematic perspective view of a guide device for guiding printed medium or medium onto a take-up roll in a printing system according to an embodiment of the invention.

With reference now to FIG. 1 of the drawings, an apparatus 30 for handling (i.e. loading and unloading) the take-up rolls R in the printing system 100 is shown schematically. The apparatus 30 includes a holder device 32 mounted on a frame 33 of the apparatus 30 for holding a take-up roll R in a take-up position $P_T$, such that the take-up roll R is able to rotate about its central longitudinal axis C in the take-up position $P_T$ for taking-up printed medium M output from the printing system 100. In this regard, the take-up roll R comprises a tubular or cylindrical roll core typically made of cardboard or plastic which is driven in the take-up position $P_T$ to rotate about its central axis C in order to wind up the printed medium M as it emerges from the printing heads or from a drying and fixing portion of the system 100. As can be seen in FIG. 3, the apparatus 30 comprises a roll supply 34 for storing a plurality of take-up rolls R, each of which is provided as a tubular or cylindrical roll core typically made of cardboard or plastic. The roll supply 34 is in the form of a hopper mounted on the frame 33 of the apparatus 30 and is configured to guide or feed each of the rolls R individually, preferably under gravity, to a loading position $P_L$ at or adjacent to the holder device 32.

With reference now also to FIG. 1 of the drawings, the holder device 32 comprises a holder member 35 which is rotatable about an axis O of rotation (i.e. parallel to axis C of the take-up roll R in the take-up position $P_T$) and includes three separate holding portions 36, namely a first holding portion (top side in FIG. 1), second holding portion (bottom right in FIG. 1), and third holding portion (bottom left in FIG. 1). These holding portions 36 are spaced around the holder member 35 and each is configured to receive and support a take-up roll R thereon. In this regard, each of the holding portions 36 has a respective support surface 37 that generally follows a contour of an outer surface of the take-up roll R supported thereon. Furthermore, each holding portion 36 extends between or includes prong- or finger-like ends or protrusions. The first, second and third holding portions 36 are preferably formed integrally as part of the holder member 35 and are thus configured to move simultaneously with one another.

The holder device 32 is configured so that it is rotatable to release or to discharge the take-up roll R from its position on the holder device 32 when the take-up roll R is full or when a print job is finished. In this regard, rotation of the holder device 32 to release or discharge the full take-up roll R also operates to load a new take-up roll R onto the holder device 32 and into the take-up position $P_T$. More particularly, when the holder member 35 rotates about an axis (not indicated), the first holding portion then moves from the take-up position $P_T$ to the release position $P_R$ to release or eject the full take-up roll R from the holder device 32 to a collector unit 39. The collector unit 39 is designed to collect the full take-up rolls R that are released or discharged from the holder device 32. In this regard, the collector unit 39 may be configured to receive the full take-up rolls R gently via a gradually sloping guide path 40, which stores the take-up rolls R in a sequence corresponding to the order of their release from the holder device 32.

When first holding portion moves from the take-up position $P_T$ to the release position $P_R$ during rotation of the holder member 35 about the axis O, the second holding portion moves from the loading position $P_L$ to the take-up position $P_T$ and thereby loads or receives a new take-up roll R from the supply 34 onto the holder device 32. As will be apparent from the drawings, when the first holding portion of the holder member 35 rotates from the take-up position $P_T$ to the release position $P_R$ to release or discharge the full take-up roll R from the holder device 32, the third holding portion of the holder member 35 rotates from the release position $P_R$ to the loading position $P_L$ to be position ready for the next take-up roll loading operation.

The apparatus 30 further includes a controller or control unit 41 (which may be combined or integrated with control unit 7 of apparatus 1) to control the movement of the holder device 32. In particular, the control unit 41 includes a sensor 42 for sensing or detecting when a take-up roll R has reached capacity or is full and needs to be changed. In this regard, the sensor 42 may detect the amount of printed medium M already wound onto the take-up roll in the take-up position $P_T$; for example, via a thickness of the wound amount of the medium M. Alternatively, or in addition, the control unit 41 may include a sensor 43 for detecting or registering when a print job is finished. In any case, the control unit 41 is configured to send control signals to control movement of the holder device 32 based on the data or information provided by sensors 42, 43. By controlling the movement of the holder device 32 in this way to unload—i.e. to release or discharge—a full take-up roll R, the take-up roll handling apparatus 30 then automatically operates to load or to receive a new take-up roll R form the roll supply 34 onto the holder device 32 and directly into the take-up position $P_T$.

The printing system 100 of this embodiment further comprises a guide device 20 for guiding the printed medium M towards the take-up roll R in the printing system, and an apparatus 30 for handling the take-up rolls R, and especially for loading and unloading the take-up rolls R in the system 100.

Figure 2:
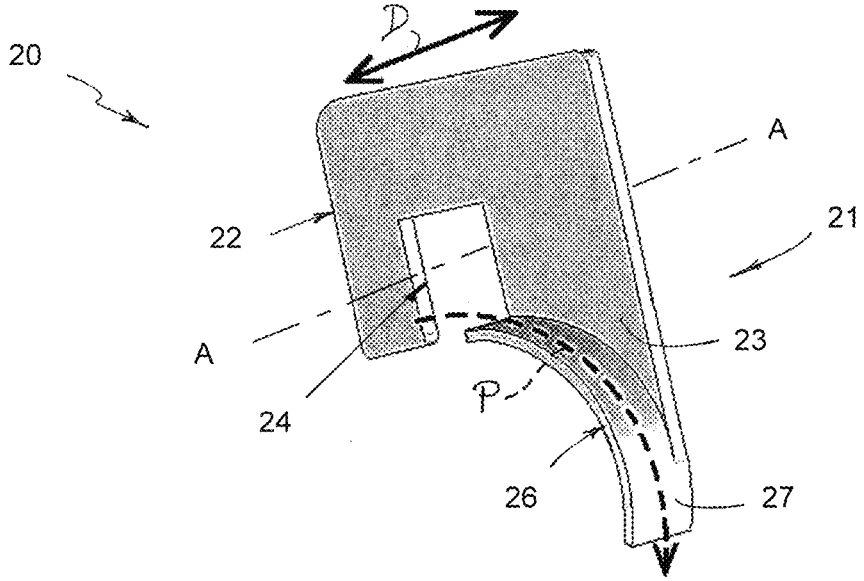
FIG. 2 is a schematic perspective view of a guide device for guiding printed medium or medium onto a take-up roll in a printing system according to an embodiment of the invention.

Thus, referring to FIGS. 2 and 3, a preferred embodiment of a guide device 20 for guiding the print medium, e.g. printed medium M, towards the receiving roll or take-up roll R in the printing system 100 is particularly suitable for wide format roll-to-roll inkjet printing systems which generally employ print web media or substrates having a width in the range of about 1 meter to about 4 meters, and more typically in the range of about 1.8 meters to 3.2 meters. As noted earlier, the take-up roll R typically comprises a tubular or cylindrical roll "core" formed of cardboard or plastic or other suitable material, which is mounted in a take-up position $P_T$ in the printing system 100 and is driven in rotation about its central longitudinal axis for winding or taking up the printed medium M on the roll. Thus, the printed medium M output from the printing system 100 via the guide device 20 is moved along the transport path P by virtue of "pushing" forces imparted to the medium M by feed rollers (not shown) as well as "pulling" forces imparted to the medium M by the driven take-up roll R.

In this embodiment, the guide device 20 comprises a pair of guide units 21, 21' and each guide unit 21, 21' includes a generally flat first guide member 22, 22' (e.g. rectangular in FIG. 2-3, but the guide member 22, 22' may also be other shapes such as circular) which presents a substantially planar surface 23, 23' for limiting or preventing lateral deviation of the medium M output from the printing system 100 as the medium M travels along the transport path P to the take-up roll R for winding or taking up a length of the medium. A position of the first guide member 22, 22' is adjustable in a direction D transverse to transport path P, and the position is able to be set to limit or prevent lateral deviation of the medium M as it travels on the transport path P. In this regard, the first guide member or flange 22, 22' includes an opening or aperture 24, 24' which forms an attachment means via which the guide unit 21, 21' is mounted on a shaft or rod 25 for adjustment of the position along an axis A in the direction D transverse to the transport path P. The axis A is typically a longitudinal axis of the shaft or rod 25 and each first guide member 22, 22' may be able to be positioned along the shaft or rod 25 in the axial direction via its opening or aperture 24, 24'. After a position of each first guide member 22, 22' (i.e. of the guide device 20) has been adjusted and set for a particular medium width, the first guide members 22, 22' remain fixed or stationary in use.

Each of the guide units 21, 21' of the guide device 20 in the embodiment of FIG. 3 further includes a second guide member 26, 26' presenting a curved support surface 27, 27' for directing or guiding medium M along the transport path P towards the take-up roll R. That is, the curved support surface 27, 27' of the second guide members 26, 26' is configured and arranged to support the printed medium thereon as the medium M travels along the transport path P towards the take-up roll. To this end, the support surface 27, 27' of each second guide member 26, 26' is desirably at least partially circularly or elliptically curved. It preferably also has low friction properties to promote easy passage of the medium M on the transport path P. In this way, support surfaces 27, 27' of the second guide members 26, 26' are configured and arranged to direct or guide the printed medium M from the buffer zone B of the printing system 100 towards the take-up roll R. Thus, during a change-over of the take-up roll R, the printing system 100 may continue printing by redirecting printed medium M to the buffer zone B until a new take-up roll R is ready to receive the medium M. The medium M collects or accumulates temporarily in one or more loose (e.g. S-shaped) folds in the buffer zone B (i.e. as a "blouse"). When a new take-up roll core is ready to wind up the folds of printed medium M or "blouse" from the buffer zone B, the curved support surfaces 27, 27' of the second guide members 26, 26' are designed to direct or guide the medium M from the buffer zone B through a curve in the transport path P defined by the curved surfaces 27, 27' towards the new take-up roll R. As is apparent from FIG. 2, the first guide members or flange members 22, 22' and the curved second guide members 26, 26' are integrally formed in the respective guide unit 21, 21' in this embodiment of the guide device 20. It will be appreciated that the curved second guide members 26, 26' may in another embodiment be separate from the first guide members 22, 22', e.g. static second guide member over which the first guide member may laterally move.

Figure 4:
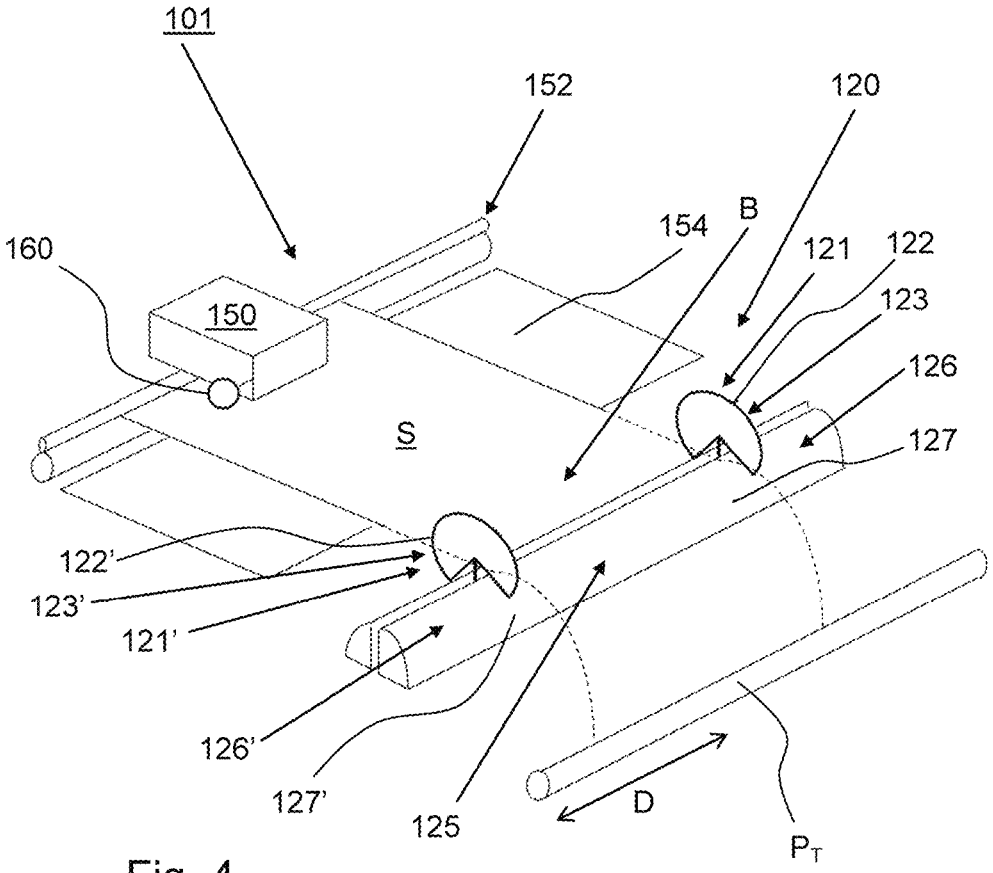
FIG. 4 is a schematic perspective view of a printing system according to another embodiment of the invention.

FIG. 4 illustrates a further embodiment of a printing system 101 according to the present invention. The printing system 101 comprises one or more actuators arranged for, preferably automatically, positioning the guide units 121, 121' with respect to the side edges of the medium M. The positions of the side edges of the medium M are sensed by a side edge position sensor 160 provided on the print head carriage 150. Alternatively, the position of a side edge may be derived from a position of the medium (or a specific region thereof) and the dimensions of the medium M, as input to the controller 7, 41. The detected positions of the side edges are communicated to the controller 7, 41, which relays said information to the actuators for the guide units 121, 121'. The actuators position the guide units 121, 121' with respect to their respective side edges of the medium M or with respect to a desired lateral position on the transport path P. Thereby, the guide units 121, 121' are aligned with the medium M without manual adjustment by an operator. This allows the operator to facilitate the feeding of the medium M at the loading or front side of the printing system 101 without concern for the position of the guide units 121, 121' at the downstream or rear end of the printing system 101.

The sensor 160 is preferably translatable along the support rail 152 in the width direction D of the medium M. The sensor 160 may be an optical detector, for example a CCD camera or optical scanner already provided on the print head carriage 150 for monitoring the print quality or registration of the print swaths on the medium M. The guide units 121, 121' are moveable in the direction D along the support shaft 125, which forms the axis A. The support surfaces 127, 127' for the medium M are formed by the curved surface of the axis A. In FIG. 4, shaft 125 or the axis A is formed as a half-cylinder, but may also be in the form of a rod with a circular or curved cross-section. The shaft 125 comprises a laterally extending recess for guiding the guide units 121, 121' in the direction D. Thus, the support surfaces 127, 127' of the second guide members 126, 126' as well as said guide members 126, 126' are static or fixed with respect to the print surface 154, while the guide units 121, 121' with their guide members 122, 122' and planar surfaces 123, 123' are translatable in the direction D by the one or more actuators controlled by the controller 7, 41.

Preferably, the guide members 126, 126' are shaped in correspondence to the support surfaces 127, 127'. An edge of a guide member 126, 126' adjacent a support surface 127, 127' follows the curvature of said support surface 127, 127'. Basically, a support surface 127, 127' and an edge of a guide member 126, 126' adjacent said support surface have a similar radius of curvature (or a similar curvature). For example, when the support surface 127, 127' is a tubular surface formed by a roll, the adjacent edge of the guide member 126, 126' is circular with a radius similar to (but slightly exceeding) a radius of the roll forming the support surface 127, 127'. This prevents damage to the medium M.

Alternative to directly transporting the medium M from the guide device 20 to a take-up roll, the medium may be transported to a finishing device (not shown) for applying a treatment to the medium, after which the medium M is transported to the take-up roll. Such a finishing device may comprise a laminator device, a trimmer device, and/or a contour cutter device. Thereby, the medium M may treated before being wound up on the take-up roll.

Figure 5:
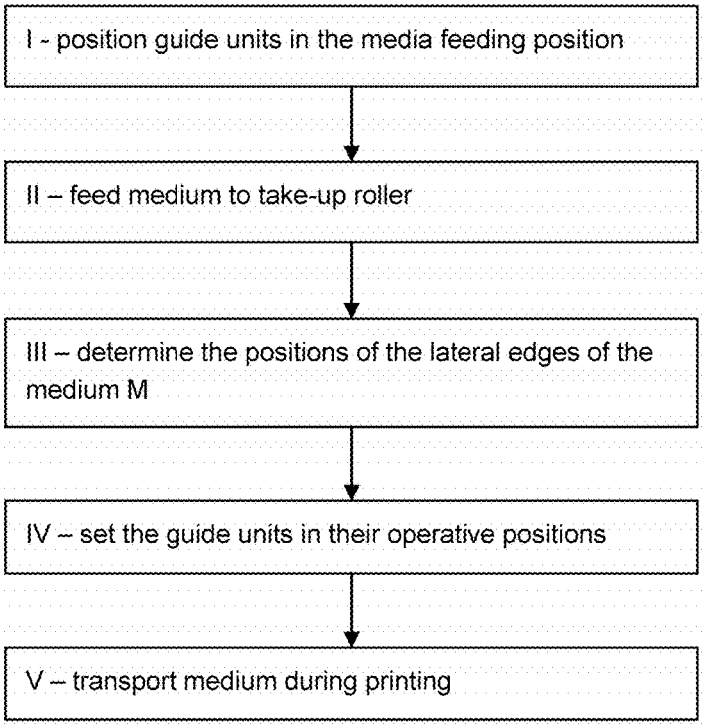
FIG. 5 is a diagram illustrating the various steps of the present invention.

The controller 7, 41 is configured to laterally adjust or set the positions of the guide units 122, 122' in correspondence to the determined lateral positions of the side edges of the medium M, as derived from the data provided by the sensor 160. The method performed by the controller is illustrated in FIG. 5. Prior to feeding the medium M through the printing system 101, the controller 7, 41 in step I positions the guide units 121, 121' in the media feeding position (MP in FIG. 4). In the media feeding position MP, the guide units 121, 121' are positioned outside the trajectory (indicated by the dashed lines in FIG. 3) of the leading $E_L$ of the medium M. During feeding (step II), there is thus no risk of contact between the guide units 121, 121' and the leading edge $E_L$. After passing the guide units 121, 121', the leading edge $E_L$ is attached to the take-up roll R (step III). The sensor 160 then determines the positions of the lateral edges of the medium M and the controller 7, 41 subsequently aligns the guide units 121, 121' with these lateral edges based on the sensor data. In step IV, the controller 7, 41 sets the guide units 121, 121' in their operative positions, as indicated by OP in FIG. 3. In the operative positions OP the guide units 121, 121' prevent lateral deviation of the medium M, as the printed medium M is being transported from the buffer zone B past the guide units 121, 121' to the take-up roll R (step V).

In another embodiment, the guide units 121, 121' comprise position sensors (not shown) for determining the lateral positions of the guide units 121, 121', such that the lateral position of the medium M (or its edges) on the support surfaces 127, 127' may be derived there from. The controller 7, 41 is then arranged to compare this downstream lateral position of the medium M to the upstream lateral position determined by sensor 160 to derive a skewing angle of the medium M with respect to the transport path P. Preferably, the controller 7, 41 emits an alert to an operator when said skewing exceeds a predefined threshold stored on the processor 7, 41. Further or alternatively, the controller 7, 41 may then laterally move the guide units 121, 121' (and thus the medium M) to re-align the medium M with the transport path P and correct the skewing. Optionally, the controller 7, 41 may stop or slow the transport and printing of the medium M.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 apparatus
2 further guide device
3 guide member or panel member
4 cutting device
5 first clamping device
6 first clamping member
6' first clamping member
7 control unit or controller
10 second clamping device
11 second clamping member
11' second clamping member
20 guide device
21 guide unit
21' guide unit
22 first guide member or flange member
22' first guide member or flange member
23 substantially planar surface
23' substantially planar surface
24 opening or aperture
24' opening or aperture
25 shaft or rod
26 second guide member
26' second guide member
27 support surface
27' support surface
30 take-up roll handling apparatus
32 holder device
33 frame
34 roll supply
35 holder member
36 holding portion
36' first holding portion
36" second holding portion
36'" third holding portion
37 support surface
38 finger or prong
39 collector unit
40 guide path of collector unit
41 control unit
42 sensor
43 sensor
100 printing system
101 printing system
120 guide device
121 guide unit
121' guide unit
122 first guide member or flange member
122' first guide member or flange member
123 substantially planar surface
123' substantially planar surface
124 opening or aperture
124' opening or aperture
125 shaft or rod
126 second guide member
126' second guide member
127 support surface
127' support surface
150 print head carriage
152 support rail
154 print surface
160 side edge position sensor
P transport path
D adjustment direction
A adjustment axis of guide device
R take-up roll or roll core
$P_T$ take-up position
$P_R$ release position
C central or rotational axis of take-up roll
B buffer zone
$G_2$ second position of the guide member
M Medium
OP Operative position
MP Media feeding position

The invention claimed is:

1. A guide device for guiding a print medium onto a take-up roll in a printing system, adjustable to accommodate print media of different widths, comprising:

a first guide member comprising a contact surface for contacting a side edge of a printed medium output from the printing system as the medium moves along a transport path towards a take-up roll for winding up a length of the medium;

a first actuator for adjusting a position of the first guide member in a direction transverse to the transport path to set the position for a particular medium width;

a controller assembly comprising:

a sensor for determining a lateral position of a medium on the transport path and generating lateral position data; and a controller for receiving the lateral position data and controlling the first actuator to set the first guide member to the determined lateral position of the medium to prevent lateral deviation of the medium along the transport path.

2. The guide device according to claim 1, wherein the sensor is positioned along the transport path upstream of the first guide member, wherein the first guide member is positioned upstream of the take-up roll.

3. The guide device according to claim 1, wherein the controller is further arranged for adjusting the position of the first guide member between:

a media feeding position wherein the first guide member is positioned, such that transport of the medium on the transport path is unimpeded by the first guide member; and an operative position wherein the first guide member is positioned laterally inside the transport path for contacting a side edge of the medium to prevent lateral deviation of the medium along the transport path, and fixing the first guide member in the operative position.

4. The guide device according to claim 1, wherein the first guide member comprises a flange member, wherein the contact surface is provided on the flange member.

5. The guide device according to claim 1, wherein the first guide member comprises a pair of first guide members, the first actuator being arranged for adjusting the position of the pair of first guide members along an axis in a direction transverse to the transport path to limit lateral deviation of the printed medium between the respective contact surfaces of pair of first guide members as the medium travels along the transport path to the take-up roll.

6. The guide device according to claim 5, wherein the controller is further arranged for adjusting the position of the pair of first guide members between:

a media feeding position wherein the pair of first guide members is positioned, such that transport of the medium on the transport path is unimpeded; and an operative position wherein the pair of first guide members is positioned laterally inside the transport path with a lateral spacing of similar to a width of the medium for contacting the side edges of the medium to prevent lateral deviation of the medium along the transport path, and fixing the first guide member in the operative position.

7. The guide device according to claim 6, wherein the controller is arranged for positioning the pair of first guide members outside the transport path in the media feeding position.

8. The guide device according to claim 7, wherein the first guide member and the second guide member are integrally formed as a guide unit.

9. The guide device according to claim 6, wherein the support surface of the second guide member is substantially curved to direct or guide the medium through a curve on the transport path.

10. The guide device according to claim 1, further comprising a second guide member presenting a support surface configured and arranged to support the printed medium there-upon as the medium travels along the transport path towards the take-up roll.

11. The guide device according to claim 10, wherein the support surface of the second guide member is configured and arranged to guide the printed medium out of a buffer zone of the printing system towards the take-up roll.

12. The guide device according to claim 1, wherein:

the sensor is positioned upstream of the first guide device for determining a first lateral position of the medium;

the controller is further arranged to determine:

a second lateral position of the medium from the position of the first guide member; and a skewing of the medium with respect to the transport path by comparing the first lateral position and the second lateral position.

13. The guide device according to claim 12, wherein the controller is further arranged for:

comparing the determined skewing to a skewing reference; and emitting an alert signal when the skewing exceeds the skewing reference.

14. The guide device according to claim 1, wherein the sensor is a side edge sensor for determining a lateral position of at least one side edge of the medium on the transport path.

15. A printing system comprising a guide device according to claim 1, further comprising a buffer zone for forming a blouse in the medium, wherein the buffer zone is positioned between the sensor and the first guide member.

16. A method for guiding print a medium onto a take-up roll in a printing system, the method comprising the steps:

a sensor determining a lateral position of the medium on a transport path of the printing system and generating lateral position data;

a controller receiving the lateral position data and controlling a first actuator to set a first guide member to the determined lateral position, the first guide member comprising a contact surface for contacting a side edge of a printed medium output from the printing system as the medium moves along the transport path towards a take-up roll for winding up a length of the medium; and setting the first guide member to the determined position to prevent lateral deviation of the medium along the transport path.

17. The method according to claim 16, wherein the step of determining the lateral position comprises determining a lateral position of a side edge of the medium.

18. A method for detecting skew of a web medium, the method comprising the steps:

a sensor determining a first lateral position of the medium on the transport path;

transporting the medium from the sensor along a contact surface of a first guide member positioned along the transport path to prevent lateral deviation of the medium, the first guide member comprising a contact surface for contacting a side edge of a printed medium output from the printing system as the medium moves along the transport path towards a take-up roll for winding up a length of the medium;

determining a second lateral position of the medium from a position of the first guide member; and comparing the first lateral position and the second lateral position to determine skewing of the medium.

19. The method according to claim 18, further comprising the steps of:

comparing the determined skewing of the medium to a skewing reference;

emitting an alert signal when the determined skewing exceeds the skewing reference.

20. The method according to claim 18, further comprising the step of transporting the medium from the first guide member to a take-up roll.

* * * * *